US010376013B2

(12) United States Patent
Berry, Jr.

(10) Patent No.: US 10,376,013 B2
(45) Date of Patent: Aug. 13, 2019

(54) NO TIES SHOE INSOLE SYSTEMS

(71) Applicant: Jonathan L. Berry, Jr., Aurora, CO (US)

(72) Inventor: Jonathan L. Berry, Jr., Aurora, CO (US)

( * ) Notice: Subject to any disclaimer, the term of this patent is extended or adjusted under 35 U.S.C. 154(b) by 75 days.

(21) Appl. No.: 15/840,094

(22) Filed: Dec. 13, 2017

(65) Prior Publication Data

US 2019/0174864 A1 Jun. 13, 2019

(51) Int. Cl.
*A43B 3/00* (2006.01)
*A43B 17/00* (2006.01)
*A43C 7/02* (2006.01)

(52) U.S. Cl.
CPC ..... *A43B 3/0031* (2013.01); *A43B 17/00* (2013.01); *A43C 7/02* (2013.01)

(58) Field of Classification Search
CPC ..... A43B 3/0031; A43B 17/00; A43C 7/02
See application file for complete search history.

(56) References Cited

U.S. PATENT DOCUMENTS 4,999,888 A * 3/1991 Miller ..... A43B 1/0081 24/306
5,671,517 A * 9/1997 Gourley ..... A43B 3/0078 24/306
6,000,147 A * 12/1999 Kellerman ..... A43B 7/142 36/160
6,115,948 A * 9/2000 Mitchell ..... A41D 27/08 2/245
6,895,696 B1 * 5/2005 Sanders ..... A43B 3/0031 24/712.1
7,779,519 B2 * 8/2010 Ashwood, Jr. ..... A43C 7/02 24/712.1
2011/0041360 A1 * 2/2011 Torrance ..... A43B 3/0031 36/91
2012/0023784 A1 * 2/2012 Goldston ..... A43B 3/0031 36/137
2013/0174448 A1 * 7/2013 George ..... A43B 3/0031 36/105
2013/0205618 A1 * 8/2013 Martigny ..... A43B 3/0031 36/54
2018/0220734 A1 * 8/2018 Dyer ..... A43B 3/26

OTHER PUBLICATIONS

Youtube video titled "How to Tuck Your Laces Under Your Sole Unedited" by Gillis Wang published on Sep. 16, 2011 and available at https://www.youtube.com/watch?v=DfJ_Bvo-MwM.*

* cited by examiner

*Primary Examiner* — Blake A Tankersley

(57) ABSTRACT

The no ties shoe insole system provides a removable shoe insole having a storage compartment and method for retaining shoelaces therein. The no ties shoe insole may comprise a top portion, bottom portion, lace holes, and a plurality of hook and loop type fasteners strategically placed nearest the lace holes and inside the main shoelace storage compartment. The no ties shoe insole may be opened from the top, thereby revealing a convenient compartment for storing the original shoelaces inside the heel portion of the insole. This allows an efficient way for allowing shoes to have the ability to slide on and off without the need for tying the shoelaces.

4 Claims, 3 Drawing Sheets

NO TIES SHOE INSOLE SYSTEMS

BACKGROUND OF THE INVENTION

1. Field of the Invention

The present invention relates generally to the field of footwear and more specifically relates to shoe lacing systems.

2. Description of the Related Art

Shoelaces, sometimes called shoestrings or bootlaces, are a system commonly used to secure shoes, boots, and other footwear. They typically consist of a pair of strings or cords, one for each shoe, finished off at both ends with stiff sections, known as aglets. Each shoelace typically passes through a series of holes, eyelets, loops or hooks on either side of the shoe. Loosening the lacing allows the shoe to open wide enough for the foot to be inserted or removed. Tightening the lacing and tying off the ends secures the foot within the shoe, but sometimes makes the wearer feel uncomfortable.

There are also many shoelace accessories. There are hooks to help lace shoelaces tightly. They are especially useful for skates where tight lacing is important. Shoelace covers protect the laces, especially in some sports like wrestling. Shoelace charms are decorative, as are colored shoelaces. Some laces are colored using expensive dyes, other, more "personal" colors, are drawn-on with permanent markers. Some dress codes (especially high schools) will specifically exclude color laces and charms. Lace-locks hold laces together, eliminating the need for tying.

Many lace-lock accessories may require frequent adjustments or extra equipment in order to keep the laces in place for an extended period of time. Other lace-lock accessories make it inconvenient for the user to slip their feet into and out of a shoe without additional adjustments being made for comfort. A suitable solution is desired.

Various attempts have been made to solve problems found in footwear art. Among these are found in: U.S. Pat. No. 4,999,888 to Miller; U.S. Pat. No. 5,671,517 to Gourley; U.S. Pat. No. 6,895,696 to Sanders; U.S. Pat. No. 7,779,519 to Ashwood, Jr.; and Publication No. 2013/0205618 to Martigny. This prior art is representative of footwear.

None of the above inventions and patents, taken either singly or in combination, is seen to describe the invention as claimed. Thus, a need exists for a reliable no ties shoe insole system, and to avoid the above-mentioned problems.

BRIEF SUMMARY OF THE INVENTION

The present invention advantageously fills the aforementioned deficiencies by footwear shoelace accessories. The present invention is superior to other systems in that it effectively provides a shoe insole designed to hide the shoelaces in the heel portion of the insole.

The no ties shoe insole system provides a removable shoe insole having a storage compartment and method for retaining shoelaces therein. This allows an efficient way for allowing shoes to have the ability to slide on and off without the need for tying the shoelaces. The no ties shoe insole system may be opened from the top, thereby providing a convenient compartment for storing the original shoelaces inside the heel portion of the insole. Upon closing the top of the insole, the shoelaces may therefore be made stationary inside of the insole by means of added hook and loop fasteners or another stationary material. The insole is then properly placed inside the shoe from front to back, thereby hiding the shoelaces and converting an ordinary shoe from needing to be tied, into a comfortable and secure slip on shoe.

The no ties shoe insole system may be available in sizes ranging from children to large adults. There may further be different models or versions that vary in materials and dimensions for purposes of accommodating different shoe types including, but not limited to, dress shoes, work boots, tennis shoes, and other active footwear. The no ties shoe insole system may be constructed form materials that are soft and comfortable, but strong enough to prevent the user from feeling the shoelaces that are hidden within the insole.

The features of the invention which are believed to be novel are particularly pointed out in the specification. The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

BRIEF DESCRIPTION OF THE DRAWINGS

The figures which accompany the written portion of this specification illustrate embodiments and method(s) of use for the present invention, a no ties shoe insole system, constructed and operative according to the teachings of the present invention.

The various embodiments of the present invention will hereinafter be described in conjunction with the appended drawings, wherein like designations denote like elements.

DETAILED DESCRIPTION

The present invention is directed to a no ties shoe insole system. In one embodiment of the present invention, no ties shoe insole systems may comprise a top, bottom, and plurality of hook and loop fasteners configured to create a storage compartment for the secure organization and retention of shoe laces.

Figure 1:
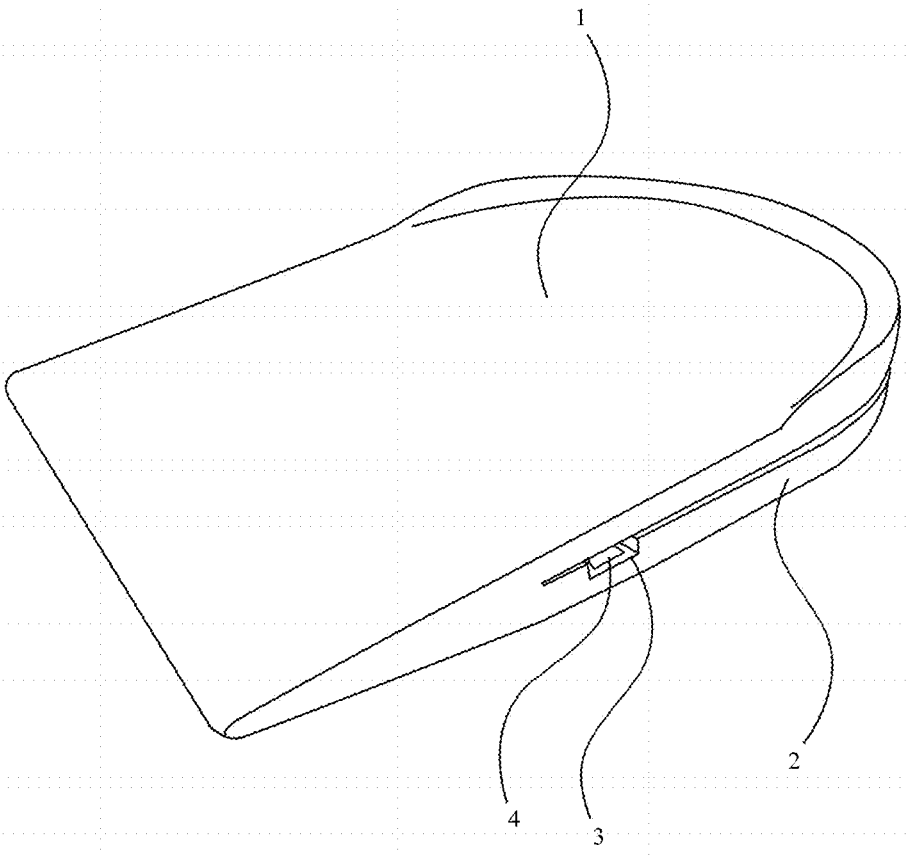
FIG. 1 is a front view of a no ties shoe insole system showing the top, bottom, lace holes, and compartment for lace holes hook and loop fasteners according to an embodiment of the present invention.

Referring now to the drawings, there is shown in FIG. 1 a no ties shoe insole system including a top portion (1), bottom portion (2), lace holes (3), and lace holes fasteners (4). The featured lace holes (3) may be small cutouts near the mid portion of the insole in between the top (1) and bottom (2) portions configured to allow an entry point for shoelaces to be threaded into the enclosed storage compartment.

Nearest the entry to the lace holes (3) there may be at least one lace hole fastener (4) for securing the shoelaces through the lace holes. The lace holes fastener (4) may be constructed from hook and loop fastener or another similar material fastener.

Figure 2:
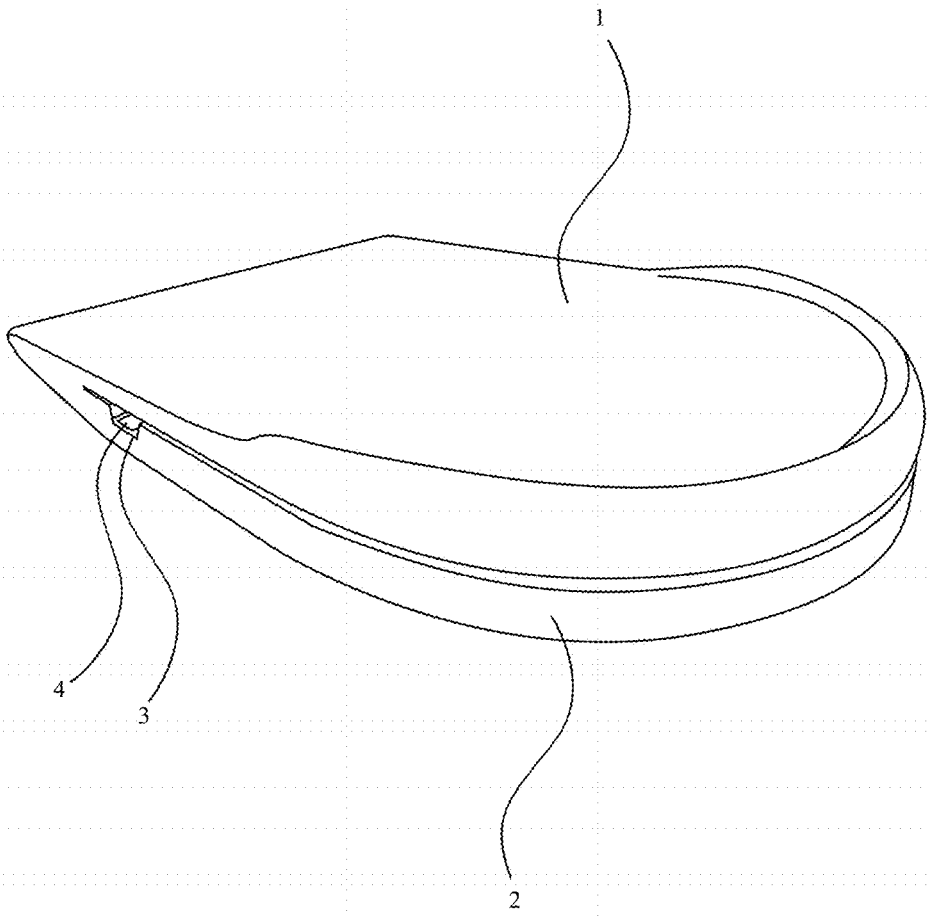
FIG. 2 is a rear perspective view illustrating the no ties shoe insole system comprising a top, bottom, lace holes, and lace holes fastener assembly according to an embodiment of the present invention.

Referring now to FIG. 2 showing a back perspective view of a no ties shoe insole system including a top portion (1), bottom portion (2), lace holes (3), and lace hole fasteners (4). The lace hole fasteners (4) may be small hook and loop tabs that hold the shoelaces in place after the shoelaces have been placed between the top and bottom portions through the included lace holes (3). Once the shoelaces have been placed through the lace holes (3) with the top (1) and bottom (2) portions rejoined, this allows an efficient way for allowing shoes to have the ability to slide on and off without the need for tying the shoelaces.

Figure 3:
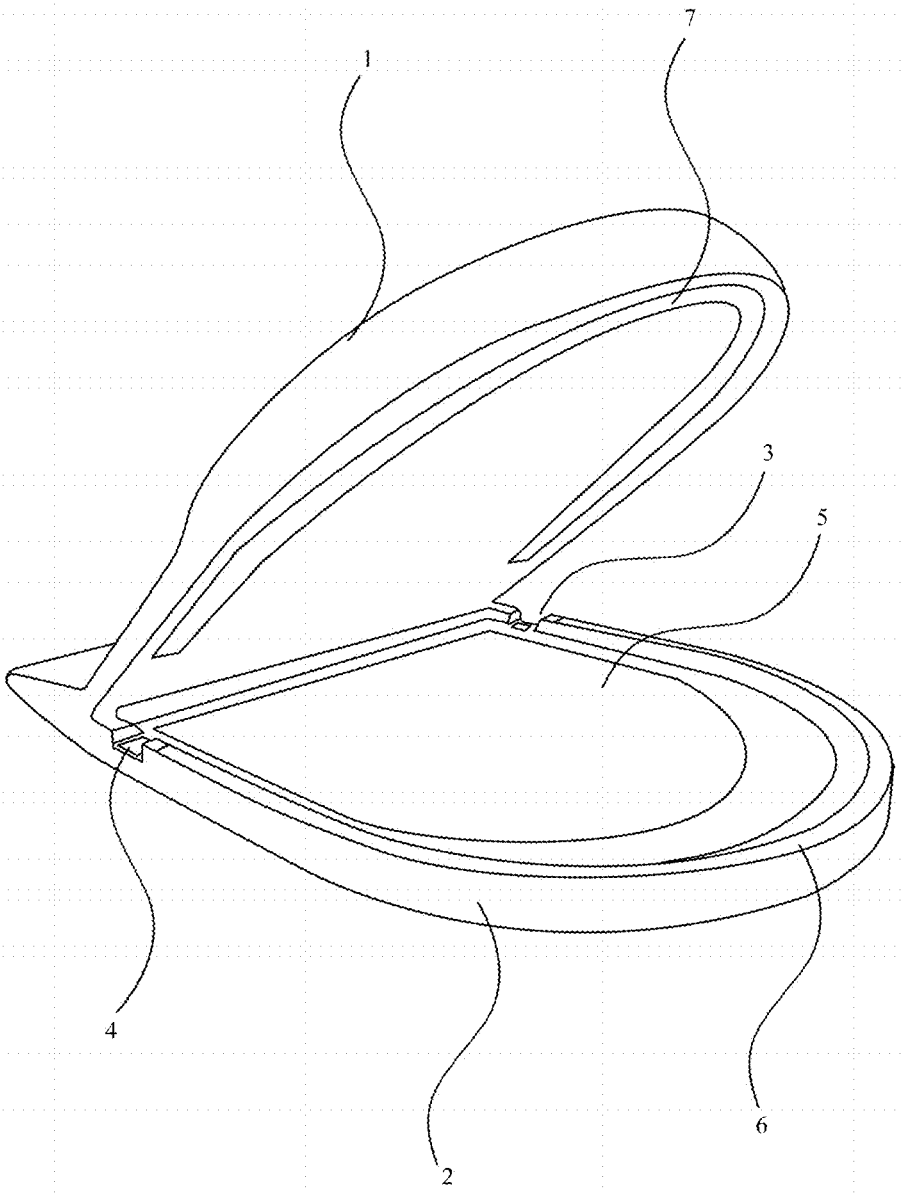
FIG. 3 is an opened rear perspective view illustrating the no ties shoe insole system according to an embodiment of the present invention showing the top and bottom separated for use along with the fastener assemblies included therein.

Referring now to FIG. 3 is an opened rear perspective view illustrating the no ties shoe insole system according to an embodiment of the present invention showing the top (1) and bottom (2) separated for use along with the fastener assemblies included therein. The top portion (1) is the area of the insole where the heal of the foot would rest. Upon lifting away the top portion (1), the storage compartment is revealed showing the lace holes fastener (4), hook and loop slab (5), "U"-shaped hook and loop 'male' side (6), and "U"-shaped hook and loop 'female' side (7). The hook and loop slab (5) is a large portion of hook and loop type material that rests inside the insole compartment on the bottom portion for holding the laces in place. The top (1) and bottom (2) portions again feature "U"-shaped hook and loop strips (6 and 7) that may be placed around the respective portions to help secure the top (1) and bottom (2) portions together once the shoe laces have been conveniently placed therein.

The exact specifications, materials used, and method of use of the no ties shoe insole system may vary upon manufacturing.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment(s) were chosen and described in order to best explain the principles of the present invention and its practical application, to thereby enable others skilled in the art to best utilize the present invention and various embodiments with various modifications as are suited to the particular use contemplated.

What is claimed is new and desired to be protected by Letters Patent is set forth in the appended claim(s):

1. A no ties shoe insole designed to hide shoelaces in a heel of a shoe comprising:

a top portion and a bottom portion, wherein the top portion and the bottom portion have a front portion at which the top portion and the bottom portion are permanently attached to each other, wherein the top portion and the bottom portion each have a back portion at which the top portion and the bottom portion are able to rotate relative to each other between an open position in which the back portions of the top portion and the bottom portion are separated from each other and a closed position in which the back portions of the top portion and the bottom portion contact each other, wherein a compartment is formed between the top portion and the bottom portion when in the closed position, and the compartment is configured to store at least a portion of the shoelaces, wherein lace cutouts are provided between the top portion and the bottom portion through which the shoelaces are configured to be threaded into the compartment from outside of the shoe insole, wherein the lace cutouts have lace cutout fasteners configured to hold the shoelaces in place and keep the shoelaces from pulling out of the compartment, and wherein the back portions of the top portion and the bottom portion are rounded to fit in a curved portion of the heal of the shoe.

2. The no ties shoe insole according to claim 1, wherein the back portions of the top portion and the bottom portion have fasteners to secure the top portion and the bottom portion in the closed position.

3. The no ties shoe insole according to claim 2, wherein the fasteners that secure the top portion and the bottom portion in the closed position are hook and loop fasteners.

4. The no ties shoe insole according to claim 1, wherein the compartment has a fastener configured to hold the shoelaces inside the compartment.

* * * * *